US010468206B2

(12) United States Patent
Park et al.

(10) Patent No.: US 10,468,206 B2
(45) Date of Patent: Nov. 5, 2019

(54) METHOD FOR PATTERNING AMORPHOUS ALLOY, AMORPHOUS ALLOY PATTERN STRUCTURE USING THE SAME, DOME SWITCH, AND METHOD FOR MANUFACTURING DOME SWITCH

(71) Applicant: SAMSUNG ELECTRONICS CO., LTD., Suwon-si, Gyeonggi-do (KR)

(72) Inventors: Eun-soo Park, Suwon-si (KR); Keum-hwan Park, Seoul (KR); Ju-ho Lee, Hwaseong-si (KR); Jin-man Park, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 396 days.

(21) Appl. No.: 15/095,609

(22) Filed: Apr. 11, 2016

(65) Prior Publication Data

US 2017/0004931 A1 Jan. 5, 2017

(30) Foreign Application Priority Data

Jul. 1, 2015 (KR) ..... 10-2015-0094338
Sep. 18, 2015 (KR) ..... 10-2015-0132130

(51) Int. Cl.
*H01H 1/021* (2006.01)
*H01H 11/04* (2006.01)
*H01H 13/785* (2006.01)

(52) U.S. Cl.
CPC ..... *H01H 1/021* (2013.01); *H01H 11/04* (2013.01); *H01H 13/785* (2013.01); *H01H 2201/022* (2013.01); *H01H 2209/0021* (2013.01)

(58) Field of Classification Search
CPC ..... H01H 1/021; H01H 11/04; H01H 2209/0021; H01H 13/785; H01H 2201/022
(Continued)

(56) References Cited

U.S. PATENT DOCUMENTS 4,766,085 A * 8/1988 Nishigaki ..... H01L 27/14665 257/E27.141
4,821,011 A * 4/1989 Kotaki ..... G01L 1/2287 338/3
(Continued)

FOREIGN PATENT DOCUMENTS

KR 10-2014-0097687 8/2014

OTHER PUBLICATIONS

"Synthesizing the Nano Composite Coating Layer of the Zr-based Bulk Glassy Alloys", 2012, 100 pages.

*Primary Examiner* — Peter Dungba Vo
*Assistant Examiner* — Kaying Kue
(74) *Attorney, Agent, or Firm* — Staas & Halsey LLP

(57) ABSTRACT

A method for patterning an amorphous alloy is provided. The method includes forming a pattern for defining an amorphous alloy deposition region on a parent material, forming an amorphous alloy deposition layer on the parent material with the pattern formed thereon, and etching a region except for the amorphous alloy deposition region. A dome switch is provided. The dome switch includes a metal layer shaped like a dome, a central portion of which protrudes, and, in response to external force being received through the protruding central portion, the central portion contacting and electrically connected to a circuit board, and an amorphous alloy layer disposed on the metal layer. Accordingly, an amorphous alloy structure with enhanced durability and reliability is easily manufactured.

14 Claims, 21 Drawing Sheets

(58) Field of Classification Search
USPC ..... 29/622, 825, 592.1
See application file for complete search history.

(56) References Cited

U.S. PATENT DOCUMENTS

| | | | | |
|---|---|---|---|---|
| 5,858,477 | A * | 1/1999 | Veerasamy | C03C 17/22 427/131 |
| 2006/0072187 | A1* | 4/2006 | McKinnell | B81B 3/0072 359/321 |
| 2011/0086246 | A1* | 4/2011 | Furukawa | H01M 10/465 429/7 |
| 2011/0186183 | A1* | 8/2011 | Johnson | C22C 45/00 148/403 |
| 2013/0052343 | A1* | 2/2013 | Dieny | B22F 9/00 427/212 |
| 2014/0008999 | A1* | 1/2014 | Prest | G01L 1/22 307/119 |
| 2014/0009215 | A1* | 1/2014 | Prest | G06F 3/044 327/517 |
| 2015/0156887 | A1* | 6/2015 | Cho | H05K 3/022 428/626 |
| 2016/0071952 | A1* | 3/2016 | Yin | H01L 29/66795 438/283 |
| 2017/0004931 | A1* | 1/2017 | Park | H01H 1/021 |

* cited by examiner

METHOD FOR PATTERNING AMORPHOUS ALLOY, AMORPHOUS ALLOY PATTERN STRUCTURE USING THE SAME, DOME SWITCH, AND METHOD FOR MANUFACTURING DOME SWITCH

CROSS-REFERENCE TO RELATED APPLICATIONS

This application claims priority from Korean Patent Application Nos. 10-2015-0094338 and 10-2015-0132130, field on Jul. 1, 2015 and Sep. 18, 2015, in the Korean Intellectual Property Office, the disclosures of which are incorporated herein by reference in their entirety.

BACKGROUND

1. Field

Apparatuses and methods consistent with the present disclosure relate to a method for patterning an amorphous alloy and an amorphous alloy pattern structure manufacturing using the same, and more particularly, a method for patterning an amorphous alloy, for effectively manufacturing a pattern structure using an amorphous alloy, and an amorphous alloy pattern structure manufactured using the method.

In addition, apparatuses and methods consistent with the present disclosure relate to a dome switch and a method for manufacturing the same, and more particularly, to a dome switch using an amorphous alloy and a method for manufacturing the dome switch.

2. Related Art

In modern industrial society, as industries such as the automobile, aviation, heavy machinery, and electronic industries have advanced, there is an absolute need to develop materials that exceed properties of typical materials.

With regard to application of crystalline materials to industry, research has been conducted to enhance the properties of crystalline materials by enhancing a solidification method and using heat treatment and so on, and many enhanced materials have been usefully used in actual industrial sites via such research.

However, modern industries have required materials that also exhibit excellent properties in very extreme situations, and accordingly, crystalline materials have a limit for such requirement.

Accordingly, there is a need for technologies for effectively preparing a structure to be used for various uses using materials with enhanced properties compared with a typical material.

SUMMARY

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides a method for patterning an amorphous alloy, for effectively manufacturing a pattern structure with a pattern appropriate for use using an amorphous alloy, and a pattern structure manufactured using the method.

The present disclosure also provides a dome switch with enhanced durability and reliability using an amorphous alloy, and a method for manufacturing the dome switch.

According to an aspect of the present disclosure, a method for patterning an amorphous alloy may include forming a pattern for defining an amorphous alloy deposition region on a parent material, forming an amorphous alloy deposition layer on the parent material with the pattern formed thereon, and etching a region except (other than, or different from) for the amorphous alloy deposition region.

The forming of the amorphous alloy deposition layer may use a sputtering method.

The forming of the amorphous alloy deposition layer may be performed at a temperature between a room temperature and 300° C.

The forming of the pattern may include attaching a film patterned so as to expose the region except for the amorphous alloy deposition region on an upper surface of the parent material, forming a material layer that reacts with acid on the exposed region of the film, and removing the film.

The film may include at least one a polymer and ceramic.

The forming of the pattern may include forming a protective layer on the upper surface of the parent material, forming a material layer that reacts with acid on an upper surface of the protective layer, and removing the protective layer and material layer formed on the amorphous alloy deposition region.

The forming of the protective layer may include forming the protective layer using any one of painting, deposition, anodizing, and spin coating.

The protective layer may include at least one of oxide, a polymer, ceramic, and a metal alloy.

The removing may include removing the protective layer and the material layer using any one of dia-cutting, grinding, and laser marking.

The etching may include etching the material layer and amorphous alloy deposition layer formed on the layer except for the amorphous alloy deposition region.

The parent material may include at least one of metal, ceramic, and a polymer.

The amorphous alloy may include at least one of iron (Fe), copper (Cu), zirconium (Zr), titanium (Ti), hafnium (Hf), zinc (Zn), aluminum (Al), silver (Ag), and gold Au).

The amorphous alloy deposition layer may include an amorphous alloy composite prepared via reaction between an amorphous alloy and gaseous nitrogen.

The amorphous alloy composite may have crystalline content between 10 at. % and 90 at. %, and a crystal grain of a crystalline structure may have a size between 5 nm and 1000 nm.

The amorphous alloy deposition layer may have a thickness between 5 nm and 10 μm.

The etching may use at least one of nitric acid, sulfuric acid, and hydrofluoric acid.

The material layer may include any one of copper and silicon oxide.

The method may further include washing a surface of the parent material before the pattern is formed.

According to an aspect of the present disclosure, an amorphous alloy pattern structure may be manufactured according to the method.

The amorphous alloy pattern structure may have a case shape of an electronic device.

According to another aspect of the present disclosure, a dome switch may include a metal layer shaped like a dome, a central portion of which protrudes, and, in response to external force being received through the protruding central portion, the central portion contacting and electrically connected to a circuit board, and an amorphous alloy layer disposed on the metal layer.

The amorphous alloy layer may have a thickness between 0.1 μm and 5 μm.

The metal layer may include a first metal layer disposed below the amorphous alloy layer, and a second metal layer disposed below the first metal layer and formed of a different material from the first metal layer.

The first metal layer may be formed of stainless steel (STS), and the second metal layer may be formed of at least one of gold (Au), silver (Ag), copper (Cu), and aluminum (Al).

The dome switch may further include a third metal layer formed above the amorphous alloy layer.

The metal layer may include gold (Au), silver (Ag), copper (Cu), and aluminum (Al), and the third metal layer may include STS.

The dome switch may further include a second amorphous alloy layer disposed on the third metal layer.

According to another aspect of the present disclosure, a method for manufacturing a dome switch may include preparing a metal layer shaped like a dome, a central portion of which protrudes, and, in response to external force being received through the protruding central portion, the central portion contacting and electrically connected to a circuit board, and forming an amorphous alloy layer on the metal layer.

The forming of the amorphous alloy layer may use at least one of sputtering, thermal spray coating, and cladding.

The forming of the amorphous alloy layer may be performed at a temperature between a room temperature and 500° C.

Additional and/or other aspects and advantages of the disclosure will be set forth in part in the description which follows and, in part, will be obvious from the description, or may be learned by practice of the disclosure.

BRIEF DESCRIPTION OF THE DRAWINGS

The above and/or other aspects of the present disclosure will be more apparent by describing certain exemplary embodiments of the present disclosure with reference to the accompanying drawings, in which.

DESCRIPTION OF EMBODIMENTS

Certain exemplary embodiments of the present disclosure will now be described in greater detail with reference to the accompanying drawings. In the following description of the present disclosure, a detailed description of known functions and configurations incorporated herein will be omitted when it may make the subject matter of the present disclosure unclear. The following embodiments may, however, be embodied in many different forms and should not be construed as limited to the exemplary embodiments set forth herein. Rather, these embodiments are provided so that this disclosure will be thorough and complete, and will fully convey the scope of the disclosure to those skilled in the art.

The terms "first", "second", etc. may be used to describe diverse components, but the components are not limited by the terms. The terms are only used to distinguish one component from the others.

In addition, when a certain part "includes" a certain component, this indicates that the part may further include another component instead of excluding another component unless there is no different disclosure. Various elements and regions in the following drawings may be schematicalloy illustrated. Accordingly, the technical aspect of the present disclosure is not limited to a relative size or interval illustrated in the accompanying drawings.

Figure 1:
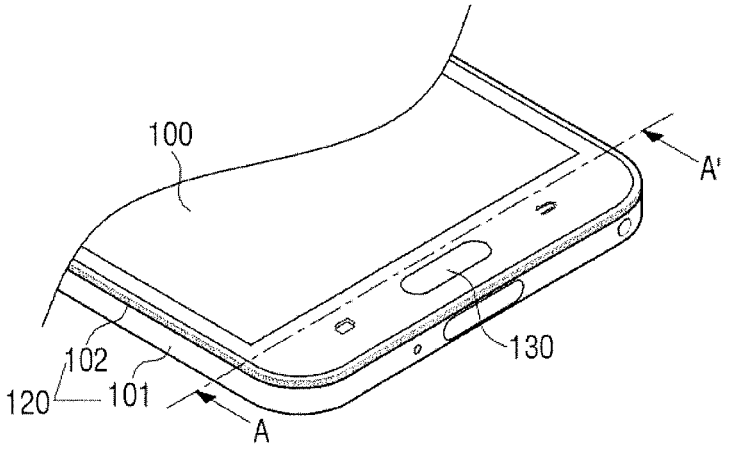
FIG. 1 is a diagram illustrating an example of an electronic device using an amorphous alloy pattern structure and a dome switch that are manufactured according to an exemplary embodiment of the present disclosure.

FIG. 1 is a diagram illustrating an example of an electronic device 100 using an amorphous alloy pattern structure and a dome switch that are manufactured according to an exemplary embodiment of the present disclosure.

Referring to FIG. 1, the electronic device 100 may include a case 120 and a button part 130. In this case, the case 120 of the illustrated electronic device 100 may an amorphous alloy pattern structure prepared according to an exemplary embodiment of the present disclosure and a parent material 101 and an amorphous alloy deposition layer 102, which constitute a case.

Although not shown, a button switch configured by a dome switch including an amorphous alloy layer and the button part 130 will be described below in detail with reference to 16.

Figure 2:
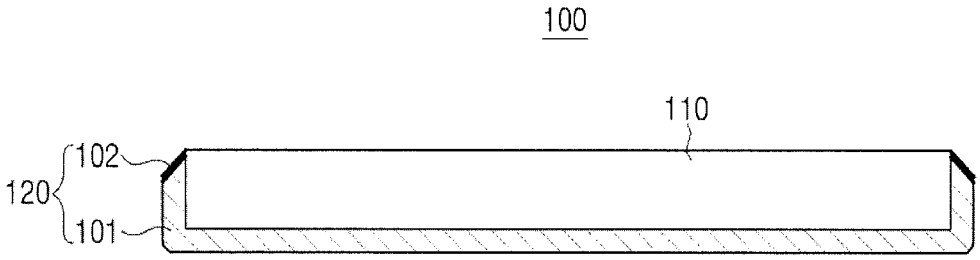
FIG. 2 is a cross-sectional view formed by enlarging a sectional view of the electronic device viewed in a direction of A-A' of the electronic device of FIG. 1.

FIG. 2 is a cross-sectional view formed by enlarging a sectional view of the electronic device 100 viewed in a direction of A-A' of the electronic device 100 of FIG. 1.

Referring to FIG. 2, the sectional view of the illustrated electronic device may include an internal space 110 of the electronic device and a case. The internal space 110 of the electronic device may include components such as a display, a circuit board, a storage, and controller. Components in the internal space 110 are not illustrated for convenience of description. The case of the electronic device may include the parent material 101 and the amorphous alloy deposition layer 102.

Here, the parent material 101 may refer to a material on which an amorphous alloy pattern is to be formed according to an exemplary embodiment of the present disclosure.

A parent material may be at least one of most metals such as iron (Fe), nickel (Ni), copper (Cu), aluminum (Al), titanium (Ti), zinc (Zn), hafnium (Hf), zirconium (Zr), cobalt (Co), gold (Au), silver (Ag), chromium (Cr), tantalum (Ta), and tungsten (W), an alloy such as a Fe-based alloy and steel use stainless (SUS), metal oxide or metal nitride such as silicon carbide (SiC), silicon nitride (SiN), zirconia, alumina, and tungsten carbide, ceramic such as alloy oxide or nitride, and a polymer such as polyvinyl chloride resin, polystyrene resin, polyethylene resin, phenol resin, and melamine resin Although FIG. 2 illustrates an amorphous alloy pattern structure prepared according to an exemplary embodiment of the present disclosure without any process on a surface of the parent material 101, a surface of a parent material may be processed and then an amorphous alloy pattern structure according to an exemplary embodiment of the present disclosure may be prepared.

The amorphous alloy deposition layer 102 may be a layer formed using an amorphous alloy and may be formed to a thickness between 5 nm and 10 μm.

Here, the amorphous alloy may refer to metal with a structure in which atoms are disorderedly arranged compared with metal crystal in which metallic atoms are periodicalloy arranged in a wide range.

General metal crystal has metallic properties whereby atoms are periodicalloy arranged and the general metal crystal is easily processed but has low intensity.

The amorphous alloy has uniform isotropic properties without anisotropy, grain boundary, surface defect, segregation, and so on which are exhibited in a general crystalline structure alloy.

Compared with the general crystalline structure alloy, the amorphous alloy may have no crystallographic anisotropy and thus may have excellent mechanical strength, and the amorphous alloy may have uniform structure and composition and thus may have excellent corrosion resistance.

In addition, the metal crystal has a limit in being patterned in a size of crystal grain or less due to existence of the crystal grain, but the amorphous alloy is advantageous in that there is no limitation of a patterning size due to very small crystal grains or non-existence of crystal grains and desired patterning is achieved.

In general, an amorphous alloy may be prepared using a melt-spinning method for rapidly cooling liquid-state metal melted by applying heat to a crystalline structure alloy in a very short time period. In addition, the amorphous alloy may also be prepared using a vacuum deposition or a sputtering method for directly preparing metal as gas.

An amorphous alloy used in an exemplary embodiment of the present disclosure may have a crystal grain with a size equal to or smaller than 1 nm and has an amorphous content that exceeds 50 at. % (atomic %), and particularly, 90 at. %, and more particularly, 99 at. %.

The amorphous alloy used in an exemplary embodiment of the present disclosure may include at least one of alloying elements of iron (Fe), copper (Cu), zirconium (Zr), titanium (Ti), hafnium (Hf), zinc (Zn), aluminium (Al), silver (Ag), gold (Au), cobalt (Co), nickel (Ni), magnesium (Mg), tin (Sn), palladium (Pd), phosphorus (P), beryllium (Be), niobium (Nb), gallium (Ga), silicon (Si), boron (B), carbon (C), and so on.

The amorphous alloy deposition layer 102 may include an amorphous alloy composite.

The amorphous alloy composite may be prepared via reaction between an amorphous alloy and gaseous nitrogen. The amorphous alloy composite may have crystalline content between 10 at. % and 90 at. % and a crystal grain of a crystalline structure may have a size between 5 nm and 1000 nm.

Hereinafter, a method for preparing an amorphous alloy pattern structure will be described.

An amorphous alloy patterning method according to an exemplary embodiment of the present disclosure may use a method for embodying micro and nano patterning via molding in a temperature of a supercooled liquid region of an amorphous alloy.

Alternatively, the amorphous alloy patterning method may use a method for embodying micro and nano patterning of an amorphous alloy by localloy crystallizing a surface of the amorphous alloy using an electromagnetic and optical energy and melting a crystallized portion using an electrochemical polishing method.

Alternatively, the amorphous alloy patterning method may use a method for embodying micro and nano patterning by forming an amorphous alloy deposition layer via deposition on a parent material and using selective etching.

However, a patterning method via molding at a temperature of a supercooled liquid region of an amorphous alloy has a problem of manufacturing an initial molding mold and is disadvantageous in that there is a limit in using equipments because vacuum or atmosphere is required during molding and that only patterning with a simple shape is achieved.

In addition, a patterning method for locally crystallizing a surface of an amorphous alloy as an energy source and melting a crystallized portion using an electrochemical polishing method is disadvantageous in that there is a limit of patterning accuracy due to difficult local heat treatment using a heat source.

Accordingly, hereinafter, an amorphous alloy patterning method via deposition of an amorphous alloy deposition layer and selective etching will be described.

Figure 3:
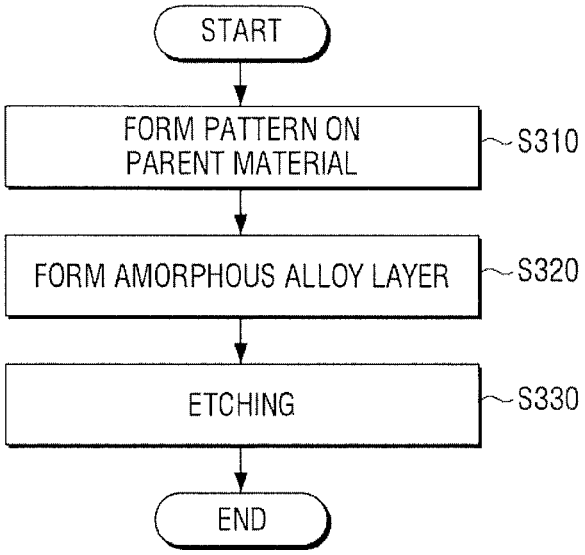
FIG. 3 is a flowchart for explanation of an amorphous alloy patterning method according to an exemplary embodiment of the present disclosure.

FIG. 3 is a flowchart for explanation of an amorphous alloy patterning method according to an exemplary embodiment of the present disclosure.

Referring to FIG. 3, first, a pattern for definition of an amorphous alloy deposition region may be formed on a parent material (S310). In detail, the pattern may be formed on the parent material using a patterned film or a mechanical method.

Here, the amorphous alloy deposition region refers to a region of a surface of a parent material, in which an amorphous alloy deposition layer is formed. The amorphous alloy deposition region may be defined according to a pattern, which will be described in detail with reference to FIGS. 4 to 7 and 10 to 13.

Then the amorphous alloy deposition layer may be formed on the parent material with the pattern formed thereon (S320). In detail, the amorphous alloy deposition layer may be formed on the parent material with the pattern formed thereon via physical vapor deposition (PVD) or chemical vapor deposition (CVD).

Here, the PVD refers to a method for vaporizing metal in vacuum and forming the vaporized metal on a parent material while the vaporized metallic atoms are not oxidized. In addition, an example of the PVD may include vacuum deposition, sputtering, and ion plating.

Here, the vacuum deposition refers to a method for pushing vapor of an alloy generated by heating metal at a high temperature toward a thin film of a parent material. The vacuum deposition is advantageous in terms of excellent deposition speed and easy handling.

In addition, the sputtering is a type of a vacuum deposition method and refers to a method for forming a layer on a surface of a parent material by making gas with no reactivity, such as argon ionized by generating plasma in a relatively low degree of vacuum, to collide with a target alloy to eject atoms of the target alloy. When reactive gas is used, a reactant between a target atom and gas may be deposited on the surface of the parent material.

In addition, the ion plating is a new technology of vacuum deposition and refers to a vacuum deposition method for applying positive electric charges to ionize vapor of an alloy and biasing a parent material with negative electric charges to make a high voltage between the alloy and the parent material. The ion plating is advantageous in that a formed film has high density and a compound film is obtained.

Here, the CVD refers to a method for making vapors of alloy compound to flow around a parent material maintained at a high temperature to form a film on a surface of a parent material via thermal decomposition or hydrogen reduction.

According to an exemplary embodiment of the present disclosure, an amorphous alloy deposition layer may be formed via sputtering, without being limited thereto, and thus the deposition method may be used. In detail, the amorphous alloy deposition layer may be formed at a temperature between room temperature and 300° C. Here, the room temperature may be 25° C.

Then, a region except (other than, or different from) for the amorphous alloy deposition region may be etched (S330). In detail, the region except for the amorphous alloy deposition region may be etched using a chemical etching method.

Here, etching refers to a processing method using corrosive action. Coating treatment may be performed on a required portion in order to prevent the required portion being corroded by an etching solution. In this regard, since an amorphous alloy is resistant to corrosion, only a material layer that reacts with acid and an amorphous alloy deposition layer formed on the material layer are removed by an etching solution. An example of the etching solution may include nitric acid, hydrofluoric acid, sulfuric acid, phosphoric acid, acetic acid, picric acid soda, and so on.

FIGS. 4 to 7 are schematic diagrams for explanation of a procedure for forming a pattern for defining an amorphous alloy deposition region on a parent material, according to an exemplary embodiment of the present disclosure.

Figure 4:
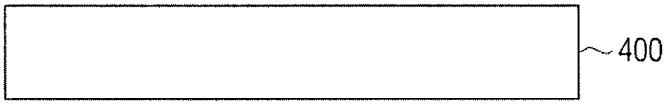
FIGS. 4 to 9 are schematic diagrams for explanation of a procedure for forming a pattern for defining an amorphous alloy deposition region on a parent material, according to an exemplary embodiment of the present disclosure.

Referring to FIG. 4, first, a parent material 400 on which an amorphous alloy deposition layer is to be formed may be prepared. The procedure may further include washing an upper surface of the parent material 400, on which the amorphous alloy layer is to be formed via deposition.

Figure 5:
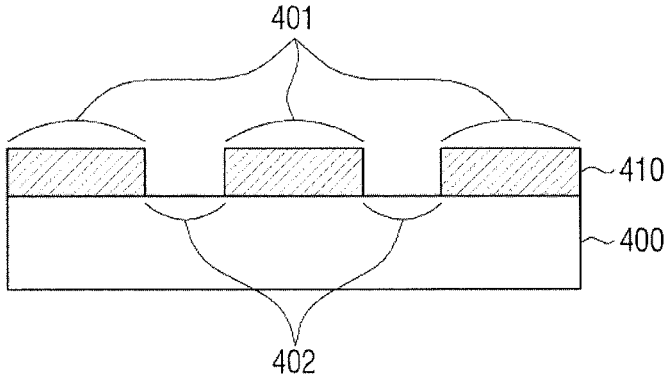

Then, as illustrated in FIG. 5, a patterned film 410 may be attached to an upper surface of the parent material 400 so as to expose a region 402 except for an amorphous alloy deposition region 401.

Here, the amorphous alloy deposition region 401 refers to a region of the parent material 400, on which an amorphous alloy deposition layer is formed and may be defined by a pattern.

In addition, the region 402 except for the amorphous alloy deposition region 401 refers to a region of the parent material 400 except for the amorphous alloy deposition region 401, on which the amorphous alloy deposition layer is not formed.

The patterned film 410 that is formed so as to expose the region 402 except for the amorphous alloy deposition region 401 refers to a film that is patterned so as to attach a film onto only a region of a parent material surface, on which the amorphous alloy deposition layer is formed, when the film is attached onto an upper surface of the parent material 400. Accordingly, the film is not attached onto the region 402 except for the amorphous alloy deposition region 401.

The film 410 may be configured with at least one of a polymer and ceramic. For example, the film 410 may be a polyester film, a polycarbonate film, glass, or the like.

Figure 6:
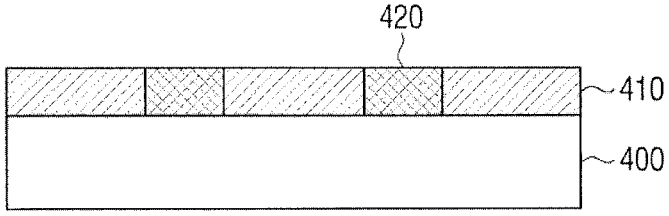

In addition, as illustrated in FIG. 6, a material layer 420 that reacts with acid may be formed on the region 402 except for the amorphous alloy deposition region, onto which the film illustrated in FIG. 5 is not attached.

An amorphous alloy deposition layer that is formed on an undesired region via deposition may be removed from the material layer 420 that reacts with acid via a subsequent etching process. For example, a material that reacts with acid may be most crystalline metals such as copper, nickel, and tin, and oxide such as silicon oxide and aluminum oxide.

A material layer that reacts with acid may be formed using any one of painting, deposition, electroplating and electroless plating.

Here, the painting refers to a method for painting a coating material on a surface of a parent material to form a film. The painting may prevent a parent material from being corroded and abraded, enhance durability, and make an aesthetic surface of an object.

Plating refers to a method for thinly covering a surface of a parent material with other metal. An example of the plating may include electroplating using an electrolysis phenomenon and electroless plating for precipitating metal on a surface of a parent material while reducing the metal by a reducing agent since a plating solution contains a reducing agent component. The electroless plating is advantageous in terms of a constant thickness compared with the electroplating.

Although FIG. 6 illustrates the case in which a material layer is formed by as much as a thickness of a film, the material layer may be formed with a smaller thickness than that of the film or may also be formed to a thickness so as to cover an upper portion of the film.

Figure 7:
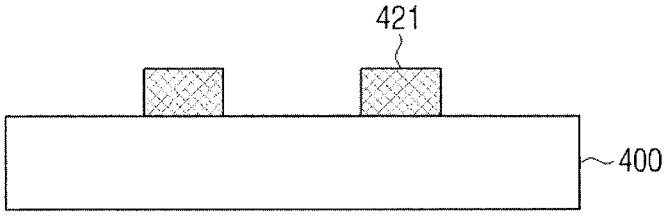

In addition, as illustrated in FIG. 7, the patterned film 410 may be removed. The patterned film may be removed such that a material layer 421 that reacts with acid remains in only a region except for an amorphous alloy deposition region. Accordingly, the pattern for defining the amorphous alloy deposition region may be formed on the parent material.

Figure 8:
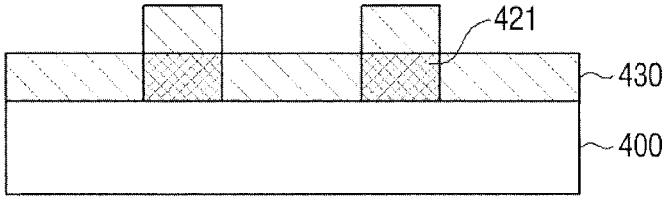

FIG. 8 is a schematic diagram illustrating a procedure for forming an amorphous alloy deposition layer on a parent material with a pattern formed thereon.

Referring to FIG. 8, the material layer 421 that reacts with acid may be formed to form an amorphous alloy deposition layer 430 on a parent material with the pattern formed thereon. In detail, in general, the amorphous alloy deposition layer may be formed on the parent material via sputtering, without being limited thereto, and thus all of the methods including PVD described with reference to FIG. 3 may be used, and thus the repeated description will be omitted.

Figure 9:
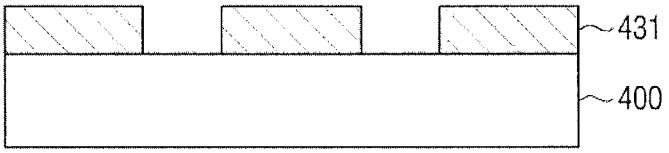

FIG. 9 is a schematic diagram illustrating a procedure for etching a region except for an amorphous alloy deposition region.

Referring to FIG. 9, the region except for the amorphous alloy deposition region may be etched. Here, the etching procedure may use the etching method described with reference to FIG. 3, and thus the repeated description will be omitted.

The material layer that reacts with acid formed on a region except for an amorphous alloy deposition region may react with an etching solution, and thus the amorphous alloy deposition layer formed on the material layer may also be removed together. Accordingly, an amorphous alloy deposition layer 431 may remain only in the amorphous alloy deposition region.

FIGS. 10 to 13 are schematic diagrams for explanation of a procedure for forming a pattern for defining an amorphous alloy deposition region on a parent material, according to another exemplary embodiment of the present disclosure.

Figure 10:
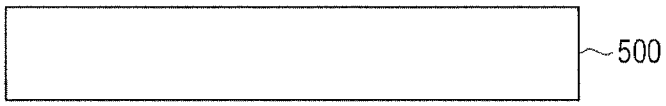
FIGS. 10 to 15 are schematic diagrams for explanation of a procedure for forming a pattern for defining an amorphous alloy deposition region on a parent material, according to another exemplary embodiment of the present disclosure.

Referring to FIG. 10, first, a parent material 500 on which an amorphous alloy deposition layer is to be formed may be prepared on a desired region. The procedure may include washing an upper surface of the parent material 500, on which the amorphous alloy layer is to be formed via deposition.

Figure 11:
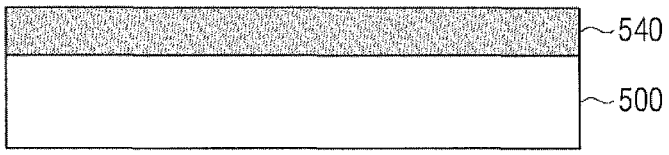

Then, as illustrated in FIG. 11, a protective layer 540 may be formed on an upper surface of the parent material 500.

Here, the protective layer 540 may protect a parent material from an etching solution, may be formed over an entire upper surface of the parent material 500, and may be at least one of oxide, a polymer, ceramic, and a metal alloy.

Here, the metal alloy refers to a complex generated by combining organic component or metal ion with metal or metal ion. The metal alloy may include a wide range of compound including metallocene as $MoO_2(CH_3CHOCHOCHCOCH_3)_2$, $[Cu(NH_3)_4]^{2+}$, $Rh[(C_6H_5)_3P]_3Cl$, or the like, chlorophyll, metalloporphyrin such as heme, metalloenzyme, and so on.

The protective layer 540 may be formed using any one of the painting, deposition, anodizing, and spin coating.

Here, the anodizing refers a method for performing electrolysis on electrolyte aqueous solution using a metal as a positive electrode to generate an anti-corrosion oxide film on a metal surface. The anti-corrosion oxide film has excellent anti-corrosion property and anti-abrasion property, enhances adhesive strength of painting, and has luster like metal so as to improve appearance.

The spin coating refers to a coating method for dropping a solution of a material to be coated or a liquid material on a parent material and rotating the parent material at high speed so as to thinly spread the parent material. A coating thickness is adjusted according to an angular velocity of rotation of the parent material, and as an angular velocity is increased, the coating thickness is slimmed.

Figure 12:
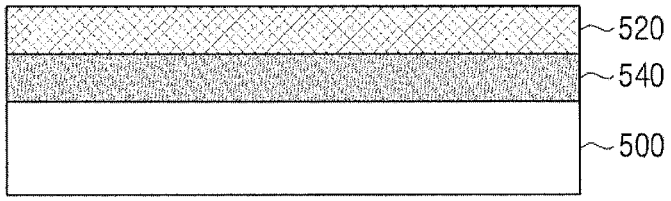

In addition, as illustrated in FIG. 12, a material layer 520 that reacts with acid may be formed on an upper surface of the protective layer 540.

Here, the amorphous alloy deposition layer formed on a region except for the amorphous alloy deposition region will be removed from the material layer 520 that reacts with acid via etching.

The material layer 520 that reacts with acid may be formed over an entire upper surface of the protective layer 540. In detail, the material layer 520 that reacts with acid may be formed via painting, deposition, electroplating, electroless plating, and so on.

Figure 13:
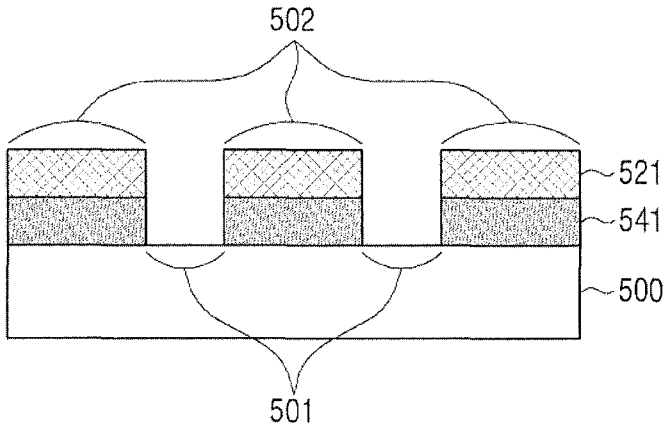

As illustrated in FIG. 13, a protective material and a material layer formed on an amorphous alloy deposition region 501 may be removed. Accordingly, the amorphous alloy deposition layer may remain only on a desired region of the upper surface of the parent material.

Here, the amorphous alloy deposition region 501 refers to a region of the parent material 500, on which the amorphous alloy deposition layer is formed.

In addition, the region 502 except for the amorphous alloy deposition region refers to a region of the parent material 500 except for the amorphous alloy deposition region 501, on which the amorphous alloy deposition layer is not formed.

Referring to FIG. 13, the protective layer and the material layer of the amorphous alloy deposition region 501 may be removed such that a protective layer 541 and a material layer 521 of a region 502 except for an amorphous alloy deposition region remain on the parent material to form a pattern.

The protective layer and the material layer may be removed using a mechanical method. In detail, any one of dia-cutting, grinding, and laser marking may be used.

A method for cutting a parent material with a cutting tool is referred to as cutting, and a method using a cutting tool including a tip formed of diamond for cutting the parent material is referred to as a dia-cutting. A dia-cut surface has low anti-corrosion property and is vulnerable to scratch. Accordingly, when an amorphous alloy deposition layer is formed via deposition on a dia-cut surface using an amorphous alloy patterning method according to an exemplary embodiment of the present disclosure, anti-corrosion property and anti-scratch property may be enhanced while maintaining design and metal luster.

In addition, the grinding refers to a processing method using a grinder for cutting a surface of a parent material on a grinding stone that rotates at high speed. When the grinder is used, it is advantageous that a precise dimension is achieved, a very hard surface is easily trimmed, and a surface is aesthetic. An example of the grinding stone may include diamond, emery, spinel, fused alumina, silicon carbide, cubicboronnitride (CBN), and so on.

In addition, the laser marking refers to a method for carving a pattern on a surface of a parent material using a laser. In various industrial environments, it is advantageous that the laser marking is flexibly used in a wide range of parent materials such as a semiconductor and metal and is conveniently and economically used.

Figure 14:
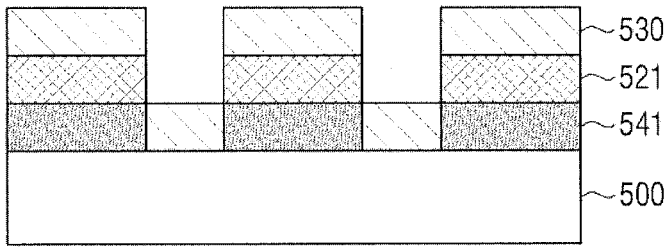

FIG. 14 is a schematic diagram illustrating a procedure for forming an amorphous alloy deposition layer on a parent material with a pattern formed thereon.

Referring to FIG. 14, an amorphous alloy deposition layer 530 may be formed on the parent material with a pattern formed thereon using a mechanical method.

In detail, in general, the amorphous alloy deposition layer may be formed via sputtering, without being limited thereto, and thus all of the methods including PVD described with reference to FIG. 3 may be used.

Figure 15:
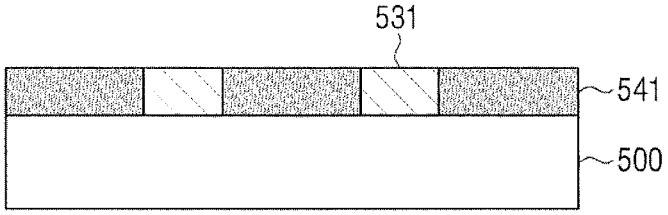

Referring to FIG. 15, a region except for the amorphous alloy deposition region may be etched.

The material layer 521 that reacts with acid formed on the region 502 except for an amorphous alloy deposition region may react with an etching solution, and thus the amorphous alloy deposition layer formed on the material layer may also be removed together. Accordingly, an amorphous alloy deposition layer 531 may remain only in a desired region.

As illustrated in FIG. 15, an amorphous alloy pattern structure manufactured using a method according to another exemplary embodiment of the present disclosure may include the protective layer 541.

The amorphous alloy pattern structure manufactured using the above method may be used in various ways such as a case or a portion thereof of an electronic device, an internal component, a flexible nano electrode, or the like.

According to the diverse exemplary embodiments of the present disclosure, an amorphous alloy pattern structure having an appropriate pattern may be effectively manufactured. In particularly, an amorphous alloy structure having a fine pattern may be more precisely manufactured compared with a conventional case. Accordingly, it may be possible to obtain a super high strength material using an amorphous alloy, specific strength may be enhanced so as to realize miniaturization, and a uniform fine structure may be formed so as to obtain an amorphous alloy pattern structure with enhanced anti-corrosion and anti-abrasion. As a result, an amorphous alloy pattern structure applicable to a fine portion of a case of an electronic device may be obtained.

Figure 16:
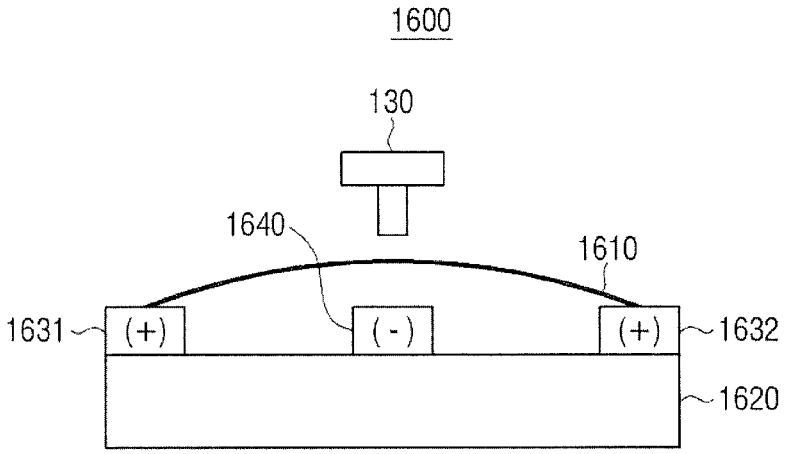
FIG. 16 is a schematic diagram for explanation of an operation of a dome switch according to an exemplary embodiment of the present disclosure.

FIG. 16 is a schematic diagram for explanation of an operation of a dome switch according to an exemplary embodiment of the present disclosure.

Referring to FIG. 16, a button switch 1600 according to an exemplary embodiment of the present disclosure may include a button part 130, a dome switch 1610, a circuit board 1620, contact points 1631 and 1632 connected to a positive electrode, and a contract point 1640 connected to a negative electrode.

The button part 130 may receive force from outside and push the dome switch 1610. In detail, when a user pushes a button part included in an electronic device with his or her finger, the button part 130 may directly receive the pushing force of the user and transmit the force to the dome switch 1610 so as to make the dome switch 1610 and the circuit board 1620 to contact each other.

The dome switch 1610 may be installed on the circuit board 1620, and in responses to external force with predetermined size or more being received through the button part 130, the dome switch 1610 may contact the circuit board 1620 so as to be electrically connected to the circuit board 1620. In detail, the dome switch 1610 may be shaped like a dome, a central portion of which protrudes, and in response to force with predetermined size or more being received through the protruding central portion, the dome switch 1610 may contact the contract point 1640 on the circuit board 1620, which has been opened, while the protruding central portion is pushed so as to connect electricity.

The dome switch 1610 may be elastically deformed with respect to external force with a predetermined size and a predetermined number of times of external force. In this case, the elastic deformation may be deformation whereby deformation generated by external force is completely restored by removing the external force. For example, the dome switch 1610 may restored to an original dome shape in response to external force that has pushed a central portion being received. Accordingly, the dome switch 1610 may repeatedly contact and open the circuit board 1620 and control electrical connection so as to function as a switch.

The dome switch 1610 may include crystalline metal shaped like a dome and an amorphous alloy layer. In detail, the dome switch 1610 may include an amorphous alloy layer on at least one surface of stainless steel (STS) shaped like a dome. In this case, the amorphous alloy layer may have a thickness between 0.1 μm and 5 μm.

The amorphous alloy layer may include a nano crystalline layer. In this case, the amorphous alloy layer may have a crystal grain with a size equal to or smaller than 1 nm, and the nano crystalline layer may have a crystal grain between 1 nm and 100 nm. In this case, the amorphous alloy layer and the nano crystalline layer may also form a uniform layer when a thin layer with a several tens of nanometers is formed via deposition, and may have high elasticity and high strength and anti-corrosion property. Accordingly, sufficient lifespan and click sensibility may be achieved using only a dome switch with a small size, and fatigue lifetime may be enhanced so as to enhance reliability of the dome switch. In addition, even if the dome switch is formed with a dome shape of the same size, the dome switch may be more highly deformed in a longitudinal direction due to a wide elastic deformation range of the amorphous alloy layer. Various configurations of a dome switch including crystalline metal shaped like a dome and an amorphous alloy layer will be described in detail with reference to FIGS. 18 to 21.

In this case, a lowermost surface of the dome switch 1610, which contacts the contract point 1640 of the circuit board 1620, may be formed of at least one of gold (Au), silver (Ag), copper (Cu), and aluminum (Al), which have excellent conductivity.

The circuit board 1620 may include electronic components that are attached thereon and are connected to form a circuit. In this case, the dome switch 1610 may be installed on a plurality of contact points of the circuit board 1620. In detail, the contact points 1631 and 1632 that the dome switch 1610 and the circuit board 1620 contact may be present on the circuit board 1620. The contract point 1640 that is spaced from the contact points 1631 and 1632, does not contact a dome switch, and is opened may be present on the circuit board 1620. In this case, the contact points 1631 and 1632 that contact the circuit board 1620 and the dome switch 1610 and the contract point 1640 that does not contact the dome switch and is opened may be electrically opposite. In detail, the contact points 1631 and 1632 that contact the circuit board 1620 and the dome switch 1610 may be positive electrodes and the contract point 1640 that does not contact the dome switch may be a negative electrode.

Although FIG. 16 illustrates only the case in which the number of contact points of the dome switch 1610 and the circuit board 1620 is two, in some embodiments, a contact point shaped like a ring may be present like a shape of the dome switch 1610.

Although FIG. 16 illustrates and describes only an example in which the contact points 1631 and 1632 that contact the circuit board 1620 and the dome switch 1610 are positive electrodes, and the contract point 1640 that does not contact the dome switch is a negative electrode, in some embodiments, the converse may be possible.

Figure 17:
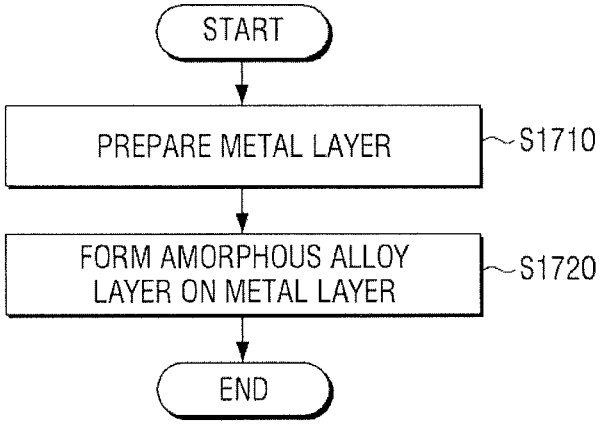
FIG. 17 is a flowchart for explanation of a method for manufacturing a dome switch according to an exemplary embodiment of the present disclosure.

FIG. 17 is a flowchart for explanation of a method for manufacturing a dome switch according to an exemplary embodiment of the present disclosure.

Referring to FIG. 17, first, a metal layer may be prepared (S1710). In this case, the metal layer may be shaped like a dome. In detail, the metal layer may be shaped like a dome, a central portion of which protrudes, and in response to external force with predetermined size or more being received through the protruding central portion, the metal layer may contact a circuit board while the protruding central portion is pushed so as to be electrically connected to the circuit board. In this case, the metal layer may be formed of a crystalline metal alloy. In detail, the metal layer may be formed of STS.

Then an amorphous alloy layer may be formed on the prepared metal layer (S1720). In detail, the amorphous alloy layer may be formed on the metal layer using at least one of sputtering, thermal spray coating, and cladding.

In this case, the amorphous alloy layer may be formed on the metal layer via sputtering. Thus far, although only an example in which the amorphous alloy layer is formed on the meal layer via deposition using a sputtering method has been described, at least one of physical vapor deposition (PVD) and chemical vapor deposition (CVD) may be used.

The thermal spray coating refers to a method for coating amorphous powders on a parent material so as to be firing-deformed by applying high speed and temperature using the amorphous powders.

The cladding refers to welding for adhering different metal to opposite surfaces or one surface of steel. The resulting structure may also be referred to as a clad sheet and may be a complex ally shaped like a layer obtained by polymerizing different metals to be completely adhered.

The amorphous alloy layer may be formed on an upper surface of a metal layer at a temperature between room temperature and 500° C.

Thus far, although only an example in which an amorphous alloy layer is formed only on the metal layer has been described, in some embodiments, the amorphous alloy layer may also be formed below the metal layer as well as on the metal layer. Accordingly, a dome switch with a small size and high reliability compared with a case in which the amorphous alloy layer is formed only on the metal layer.

Although not illustrated, a metal thin film with excellent conductivity may be formed at a lowermost portion of the manufactured dome switch. In this case, the metal thin film may be formed of aluminum (Al), copper (Cu), gold (Au), silver (Ag), or the like, which has excellent electric conductivity. In detail, when an amorphous alloy layer is formed only on the metal layer, the metal thin film may be formed below the metal layer. When the amorphous alloy layer is formed below the metal layer, the metal thin film may be formed below the formed amorphous alloy layer. Accordingly, electric conductivity of a surface of a dome switch, which contacts an electrode on a circuit board, may be enhanced so as to improve a switch operation. For convenience of processing, the metal thin film may be formed on opposite surfaces of the metal layer.

FIGS. 18 to 21 are diagrams for explanation of a structure of a dome switch according to diverse exemplary embodiments of the present disclosure.

Figure 18:
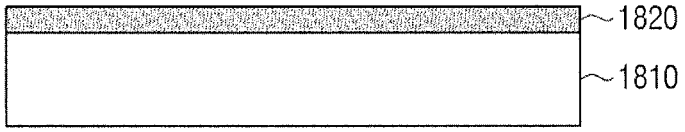
FIGS. 18 to 21 are diagrams for explanation of a structure of a dome switch according to diverse exemplary embodiments of the present disclosure.

Referring to FIG. 18, a dome switch according to an exemplary embodiment of the present disclosure may include a metal layer 1810 and an amorphous alloy layer 1820. In detail, the dome switch may include the metal layer 1810 and the amorphous alloy layer 1820 formed on the metal layer 1810. In this case, the metal layer 1810 may be formed of STS.

Figure 19:
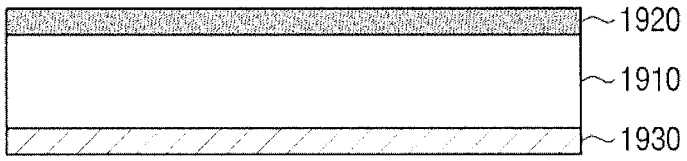

Referring to FIG. 19, a dome switch according to an exemplary embodiment of the present disclosure may include a metal layer 1910, an amorphous alloy layer 1920, and a second metal layer 1930 formed of a different material from the metal layer 1910. In detail, the dome switch may include the amorphous alloy layer 1920 formed on an upper surface of the metal layer 1910 and the second metal layer 1930 formed on a lower surface of the metal layer 1910. In this case, the metal layer 1910 may be formed of STS and the second metal layer 1930 may include at least one of gold (Au), silver (Ag), copper (Cu), and aluminum (Al), which have excellent conductivity.

Figure 20:
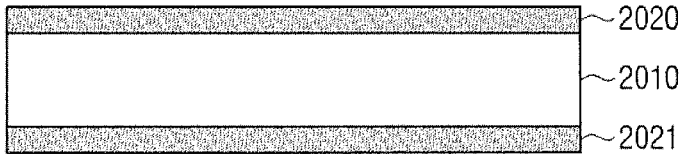

Referring to FIG. 20, a dome switch according to an exemplary embodiment of the present disclosure may include a metal layer 2010 and a plurality of amorphous alloy layers 2020 and 2021. In detail, the dome switch may include the metal layer 2010, a first amorphous alloy layer 2021 formed on a lower surface of the metal layer 2010, and a second amorphous alloy layer 2020 formed on an upper surface of the metal layer 2010. In this case, the metal layer 2010 may be formed of STS. Since a plurality of amorphous alloy layers 2020 and 2021 may be formed on opposite surface of the metal layer 2010 so as to enhance reliability, a dome switch to be miniaturized may be manufactured, and thus it may be advantageous in terms of space utilization of an electronic device.

Figure 21:
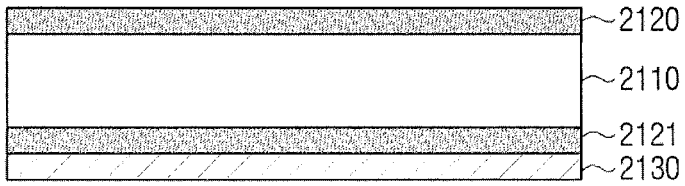

Referring to FIG. 21, a dome switch according to an exemplary embodiment of the present disclosure may include a metal layer 2110, a plurality of amorphous alloy layers 2120 and 2121, and a metal layer 2130 formed of a different material from the metal layer 2110. In detail, based on the metal layer 2130 at a lowermost portion of a dome switch, which contacts a contact point of a circuit board, the dome switch may include the metal layer 2130, a first amorphous alloy layer 2121 formed on the metal layer 2130, a third metal layer 2110 formed on the first amorphous alloy layer 2121, and a second amorphous alloy layer 2120 formed on the third metal layer 2110.

In this case, the metal layer 2130 may be formed of at least one of gold (Au), silver (Ag), copper (Cu), and aluminum (Al), which have excellent conductivity, and the third metal layer 2110 may be formed of STS. In this case, higher reliability may be achieved due to the first amorphous alloy layer 2121 and the second amorphous alloy layer 2120 that are respectively formed on and below the third metal layer 2110, and thus a dome switch to be miniaturized may be manufactured and it may be advantageous in terms of space utilization of an electronic device. Since the metal layer 2130 formed of at least one of gold (Au), silver (Ag), copper (Cu), and aluminum (Al), which have excellent conductivity, is formed below the dome switch, electric conductivity of a surface of a dome switch, which contacts an electrode of a circuit board, may be enhanced so as to improve a switch operation.

According to the aforementioned diverse exemplary embodiments of the present disclosure, a dome switch with enhanced durability and click sensibility and long lifespan may be provided due to an amorphous alloy layer, and even if the dome switch is miniaturized, reliability of the dome switch may be ensured.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A method for patterning an amorphous alloy, the method comprising:

forming, on a parent material, a pattern that defines a first region on the parent material as an amorphous alloy deposition region;

forming, on the parent material, an amorphous alloy deposition layer on the first region and on a second region on the parent material different from the first region; and etching the second region so that the amorphous alloy deposition layer is removed from the second region, wherein the forming of the pattern comprises:

attaching, to the parent material, a film patterned so as to expose a region on an upper surface of the parent material;

forming a material layer that reacts with acid on the exposed region; and removing the film, such that the material layer remains as the pattern that defines the first region and the second region, wherein the film comprises at least one of a polymer and ceramic.

2. The method as claimed in claim 1, wherein the forming of the amorphous alloy deposition layer uses a sputtering method and is performed at a temperature between a room temperature and 300° C.

3. A method for patterning an amorphous alloy, the method comprising:

forming, on a parent material, a pattern that defines a first region on the parent material as an amorphous alloy deposition region;

forming, on the parent material, an amorphous alloy deposition layer on the first region and on a second region on the parent material different from the first region; and etching the second region so that the amorphous alloy deposition layer is removed from the second region, wherein the forming of the pattern comprises:

forming a protective layer on the upper surface of the parent material;

forming a material layer that reacts with acid on an upper surface of the protective layer; and removing portions of the protective layer and the material layer that are formed on the first region, such that other portions of the protective layer and the material layer remain as the pattern that defines the first region and the second region.

4. The method as claimed in claim 3, wherein the forming of the protective layer comprises forming the protective layer using any one of painting, deposition, anodizing, and spin coating, and the protective layer comprises at least one of oxide, a polymer, ceramic, and a metal alloy.

5. The method as claimed in claim 3, wherein the removing comprises removing the portions of the protective layer and the material layer using any one of dia-cutting, grinding, and laser marking.

6. The method as claimed in claim 3, wherein the etching comprises etching the material layer and amorphous alloy deposition layer formed on the second region.

7. The method as claimed in claim 1, wherein the parent material comprises at least one of metal, ceramic, and a polymer.

8. The method as claimed in claim 1, wherein the amorphous alloy comprises at least one of iron (Fe), copper (Cu), zirconium (Zr), titanium (Ti), hafnium (Hf), zinc (Zn), aluminum (Al), silver (Ag), and gold (Au).

9. The method as claimed in claim 1, wherein the amorphous alloy deposition layer comprises an amorphous alloy composite prepared via reaction between an amorphous alloy and gaseous nitrogen.

10. The method as claimed in claim 9, wherein the amorphous alloy composite has crystalline content between 10 at. % and 90 at. %, and a crystal grain of a crystalline structure has a size between 5 nm and 1000 nm.

11. The method as claimed in claim 1, wherein the amorphous alloy deposition layer has a thickness between 5 nm and 10 μm.

12. The method as claimed in claim 1, wherein the material layer comprises any one of copper and silicon oxide.

13. A method for manufacturing a dome switch, the method comprising:

preparing a dome-shaped metal layer, the dome-shaped metal layer having a protruding central portion that, in response to an external force being applied to the protruding central portion, moves toward a point below the dome-shaped metal layer;

forming an amorphous alloy layer on one surface of the dome-shaped metal layer; and forming a metal thin film on an other surface of the dome-shaped metal layer, wherein the metal thin film contacts a circuit board in response to the external force being applied to the protruding central portion and the amorphous alloy layer does not contact the circuit board in response to the external force being applied to the protruding central portion.

14. The method as claimed in claim 13, wherein the forming of the amorphous alloy layer uses at least one of sputtering, thermal spray coating, and cladding, and the forming of the amorphous alloy layer is performed at a temperature between a room temperature and 500° C.

* * * * *